US005092924A

United States Patent [19]

Biggin et al.

[11] Patent Number: 5,092,924

[45] Date of Patent: Mar. 3, 1992

[54] COMPOSITION AND PROCESS FOR COATING METALLIC SURFACES

[75] Inventors: John G. Biggin, Temple Normanton; Peter R. Sliwinski, Erdington; Peter J. Mitchell, Great Bowden, all of England

[73] Assignee: Novamax Technologies Corporation, Norcross, Ga.

[21] Appl. No.: 447,197

[22] Filed: Dec. 7, 1989

[30] Foreign Application Priority Data

Dec. 7, 1988 [GB] United Kingdom ..... 8828559

[51] Int. Cl.[5] ..... C23F 11/00

[52] U.S. Cl. ..... 106/14.11; 106/14.12; 106/14.21

[58] Field of Search ..... 106/14.12, 14.21, 14.11

[56] References Cited

U.S. PATENT DOCUMENTS

| | | | |
|---|---|---|---|
| 2,438,877 | 3/1948 | Spruance | 148/6.16 |
| 3,185,596 | 5/1965 | Schiffman | 148/6.16 |
| 3,410,707 | 11/1968 | Pocock et al. | 106/14.21 |
| 3,706,604 | 12/1972 | Plaxton | 148/6.16 |
| 3,876,435 | 4/1975 | Dollman | 106/14.12 |
| 3,932,198 | 1/1976 | Schneider | 148/6.2 |
| 3,967,984 | 7/1976 | Helwig et al. | 148/6.16 |
| 4,169,741 | 10/1979 | Lampatzer et al. | 148/6.16 |
| 4,183,772 | 1/1980 | Davis | 148/6.16 |
| 4,227,946 | 10/1980 | Williamson | 148/6.16 |
| 4,266,988 | 5/1981 | Krippes | 148/6.21 |

FOREIGN PATENT DOCUMENTS 2131052A 6/1984 United Kingdom .

*Primary Examiner*—Mark L. Bell
*Assistant Examiner*—Deborah Jones
*Attorney, Agent, or Firm*—Weintraub, DuRoss & Brady

[57] ABSTRACT

A no-rinse aqueous chemical composition for treating a metallic surface prior to application of an organic siccative coating characterized in that it comprises from 1.5 to 40 g/l (total) of Cr (VI) and optionally one or more of Ni, Co, Mg, Fe and Zn, and from 0.3 to 6.0 g/l (total) of F and optionally $PO_4^{3-}$ is disclosed.

A process for treating a metallic surface prior to application of an organic siccative coating characterized in that it comprises applying to the surface such a composition and not rinsing is also disclosed.

10 Claims, No Drawings

COMPOSITION AND PROCESS FOR COATING METALLIC SURFACES

BACKGROUND OF THE INVENTION

1. Field of the Invention

This invention relates to a composition and process for coating metallic surfaces; more particularly, it relates to an aqueous composition which may be applied to a metallic substrate in a controlled manner, without subsequent rinsing, prior to the application of an organic siccative finish.

2. Prior Art

In order to obtain the required adhesion of decorative or corrosion-resistive organic films to ferrous or non-ferrous metallic substrates, the use of a chemical pretreatment coating between the metallic surface and the organic film is well known. As all coatings are permeable to moisture to some extent, corrosion of the metallic surface may take place underneath the organic coating which may result in loss of adhesion and the formation of blisters. Should the organic coating become damaged and broken, then underfilm corrosion of the metal surface may take place from this point. An effective chemical pretreatment system may greatly enhance the resistance of the organically-coated metallic substrate to such corrosion.

One particular industry that demands the highest standard of organic coating adhesion and corrosion resistance is the production of pre-painted metal in coil or sheet form, which is subsequently subjected to bending or forming without damage to the coating. The main chemical pretreatment coatings traditionally available to the coil coater are iron phosphates, zinc phosphates, alkaline oxide systems and chromate. In these conventional processes, the chemical reactants are normally applied to the metallic surfaces by immersion or spray in 8–16 seconds at 45°–60° C. As coil coating lines may run in excess of 100 meters per minute, to obtain the required reaction time, the reaction cell or spray section needs to be many meters long and also large holding tanks are needed to provide sufficient capacity so that the reaction products of the pretreatment process do not form an excessive proportion of the bath thereby necessitating frequent dumping and correspondingly causing large fluctuations in the constituent concentrations of the bath and associated difficulties in controlling the process.

These processes vary with regard to efficiency and produce varying quantities of by-products in the form of sludge or scale which may adhere to pipework or block spray jets. Bath control often has to be maintained within close limits and may be relatively involved. After the application of the coating, excess reaction products need to be removed by rinsing, and the rinse water then has to be treated so that toxic or undesirable materials are removed prior to disposing to effluent. It is also necessary to discard all or part of the coating bath itself when reaction products reach a certain level. Again, this requires that toxic or undesirable matter has to be removed prior to disposal to effluent. These toxic materials themselves have to be disposed of and cause the inevitable pollution of the environment.

To avoid a number of the above operational problems and particularly the creation of undesirable effluent, so-called 'no-rinse' systems have been introduced. These systems are so-called because, after the application of the appropriate chemical reactant to the metallic surface, the excess is removed by an appropriate means and returned to a reservoir to be reapplied to the metal surface. No subsequent rinsing is required and therefore there is the environmental benefit of no polluting effluent. There are two main types of 'no-rinse' systems presently available.

The first type is a reactive system which has been termed 'reacted-in-place'. This system comprises highly active chemical solutions that react with the metallic substrate in a very short time to produce the desired coating, see, for example, U.S. Pat. No. 4,266,988. By ensuring a highly active chemical solution, the time required to achieve the desired weight of coating is kept low and allows a short pretreatment section in the production line. Reactive systems inevitably produce a build-up of reaction products in the coating solution, therefore consistency and control of the solution is difficult. Furthermore, sludging of insoluble salts may occur in the circulation system if line speeds vary excessively blocking spray equipment or contaminating the substrate surface. Clearly, as there is no post-rinse, any reaction products or contaminants will remain on the metal surface and may detract from adhesion or corrosion resistance characteristics of a subsequent organic coating.

The second type of no-rinse chemical pretreatment system is the non-reactive system as disclosed in U.S. Pat. No. 4,183,772 and U.S. Pat. No. 4,227,946, for example, whereby the pretreatment solution does not react chemically with the metallic surface. The coatings formed in these processes rely primarily on adsorption on the metallic substrate as the adhesion mechanism. To achieve this, the solutions contain organic or inorganic film-forming agents and wetting agents and the solutions must be applied uniformly over the entire surface at a given coating density. This usually necessitates the use of a roll-coater for film application, whereby the wet film thickness may be controlled. After application, the film requires drying, normally at 100°–250° C., which, due to the relatively high film thickness of such coatings, requires the use of a purpose-built oven or hot air driers.

In both reactive and non-reactive no-rinse systems, the effectiveness of the pretreatment solution may be governed by the extraneous ingredients which do not contribute to the siccative organic coating adhesion and corrosion resistance. In this respect, the addition of film-forming and wetting agents to a non-rinse pretreatment solution is undesirable since they may adversely effect the long term adhesion properties of the subsequently-applied siccative coating, especially under conditions of high humidity. Similarly, the reaction products which build-up in the solution of the reactive-type no-rinse systems may be considered as extraneous ingredients which may reduce the efficacy of the pre-treatment system.

SUMMARY OF THE INVENTION

The present invention relates to an improved no-rinse chemical pretreatment system which has significant advantages over the prior art. The present approach makes use of a chemical pretreatment solution which contains no extraneous chemical ingredients, such as organic or inorganic film-forming agents, which may not contribute to subsequent adhesion or corrosion resistance of any applied organic siccative coating. The chemical reaction characteristics of the pretreatment solution with the metal substrate at the point of application are not critical, thus removing the necessity to add accelerating agents to the solution. The formulation of the chemical pretreatment solution is thus not restrained by the addition of extraneous ingredients allowing the freedom to optimise the solution to obtain the following advantages;

(1) Minimal reaction with the metallic substrate, producing no reaction products and, therefore, no danger of sludging causing spray nozzle blockages, lack of consistency in performance due to the entrapment of extraneous compounds within the coating and ease of control.

(2) Stable solutions which are effective over a wide range of pH and concentration and may, therefore, be optimised to give compatability with the widest range of siccative organic coatings.

(3) Simple application technique; no requirement for application of thick films or reaction cells.

DETAILED DESCRIPTION

The present invention provides a no-rinse aqueous chemical composition for treating a metallic surface prior to application of an organic siccative coating characterised in that it comprises from 1.5 to 40 g/l (total) of Cr (VI) and optionally one or more of Ni, Co, Mg, Fe, and Zn, and from 0.3 to 6.0 g/l (total) of $F^-$ and optionally $PO_4^{3-}$.

Generally, the pH is adjusted, for example, to from 1.8 to 9.0, preferably from 6.5 to 9.0, by the use of suitable volatile anions or cations, preferably by using ammonia. Alkali metal salts are not the preferred source of such constituents, since the inclusion thereof into a coating may cause deleterious effects on an organically-coated product when subjected to humidity.

A preferred composition may comprise from 1.5 to 15 g/l of Cr (VI) and/or about 3 g/l of $F^-$. Commonly, chromium trioxide and/or ammonium bifluoride is/are used.

The present invention also provides a process for treating a metallic surface prior to application of an organic siccative coating characterized in that it comprises applying to the surface such a composition and not rinsing. The present system is specifically intended for forming a coating on a ferrous or non-ferrous metallic substrate to which an organic coating may subsequently be applied without intermediate rinsing.

Metallic substrates which may be treated in accordance with the present invention may be of various forms, e.g. pipes, rods, wire, sheets and strips. However the preferred shapes are those that permit uniform mechanical distribution of the chemical pretreatment solution film. The present process is particularly suited to the coil-coating industry wherein the metal surfaces to be treated generally take the form of flat sheet or strip. Metals most commonly used in this industry include steel, zinc and aluminum, either pure or as alloys, whole or as a thin surface layer on steel.

Application may be by various conventional means, for example, spray, immersion, flooding, brushing or roll coating, generally followed by a smooth or textured squeegee roller to remove excess and to provide the required wet film volume, preferably from 1 to 10 $ml/m^2$, more preferably towards the lower end of that range. If a roll-coater is used, post squeegee rollers are generally not necessary as the roll-coater may be set to apply the required wet film volume. A preferred method of application is by immersion or spray, followed by squeegee rollers.

For the application of the system according to the present invention, the substrate surface should generally be clean, since oil or grease, for example, would prevent satisfactory coating of the surface with the solution, and dust and dirt, for example, would lead to surface defects in the final painted products, thus reducing the quality. As part of the process, a proprietary detergent cleaner solution suitable for use on the substrate employed should normally be used. Such a cleaning step should be followed by thorough rinsing to prevent carry-over into the chemical pretreatment step. Oxidation of the metallic surface is deleterious to the formation of good quality coatings and should preferaby be avoided. Gross oxidation of a metallic substrate would generally render it unsuitable for the formation of good quality coatings, however, thin oxide layers may be removed by suitable pre-cleaning, for example in a proprietary acid deoxidiser, prior to the chemical pretreatment step. A preferred process sequence would thus comprise, firstly, an alkaline detergent, followed by suitable rinsing; and, secondly, an acidic solution to remove oxidation products, followed by suitable rinsing; and, thereafter, the application of the present chemical pretreatment solution.

Excess coating solution may be removed and the applied layer is, thereafter, dried to give a homogeneous coating. Drying may be carried out by conventional means, but, due to the thin aqueous nature of the applied solution, simple air drying is sufficient. The preferred method of drying is by heat retained in the metal substrate from preceding operations, thus avoiding the necessity of a separated drying stage with associated expense. After drying, the metallic substrate may be coated with siccative organic coating by a conventional method. During the drying stage or in the early stages of curing the organic coating, all volatile components of the chemical pretreatment solution will be removed leaving the active constituents, thus ensuring good adhesion and corrosion resistance properties of the final coated metal.

The present invention is further illustrated by the following examples:

EXAMPLE 1

A solution according to the present invention having a pH of 6 was prepared as follows:

| | |
|---|---|
| Chromium trioxide | 12.5 g/l |
| Ammonium bifluoride | 5.0 g/l |
| Ammonia solution "880" | 16.3 g/l |

Hot dip galvanised steel panels (100×150 mm) were cleaned by immersing in a mild alkaline cleaner based on caustic potash solution, condensed phosphate and nonionic surfactant at 70° C. for 15 seconds. The panels were rinsed thoroughly and then immersed in a deoxidising solution based upon phosphoric acid at pH 4, 50° C. for 15 seconds. Excess solution was removed by passing the panels through squeegee rollers. Each cleaned panel was then treated with the above solution by passing downward through a pair of rubber rollers in which the top nip was flooded by the solution. By adjusting the rollers, 3 mls of solution per square meter remained on the surface. The solution was dried by holding in a stream of air for a few minutes.

As a control, further panels were cleaned and deoxidised as described, but were not treated with the coating solution.

The test panels were coated with a variety of organic coatings all commonly used in the coil coating industry. These are listed in Table 1:

TABLE 1

| | Dry Film Thickness |
|---|---|
| 1. Epoxy primer/polyester top coat | 8 μm/15 μm |
| 2. Epoxy primer/siliconized polyester top coat | 8 μm/15 μm |
| 3. Epoxy primer/$PVF_2$ top coat | 8 μm/20 μm |
| 4. One coat polyester | 17 μm |
| 5. Plastisol primer/plastisol | 5 μm/200 μm |

Each paint system was stoved at the manufacturer's recommended temperature. This ranged from 199° C. for the plastisol primer to 250° C. for the $PVF_2$ top coat.

The painted panels were then subjected to tests designed to assess the adhesion and corrosion resistance characteristics of the coated metal.

The tests were carried out in the following manner:

The T-bend test consists of bending the panels round 180°. The radius of the bend results from the selection of the intermediate layer acting as a pin. The panel may be rolled over and over until the radius is found whereby no paint is lost on removal of adhesive tape applied to the bent area. Thus, the greatest strain is when no intermediate layer is used and the sheet is bent until the reverse sides meet. This is termed O-T, the bending over one sheet is 1-T, and over two sheets 2-T and so on.

The boiling water test is used on the plastisol coating only: A "V"-cut was made through the coating into the substrate with a sharp blade and then a cupping indent was made of 7.5 mm depth from the reverse side such that the point of the "V" corresponded to the top of the cut. The panel was then immersed in boiling water for up to four hours and the coating picked off from the "V" if possible. The time is recorded when the coating may be picked off the surface, if no coating may be removed after four hours, then NPL (no paint loss) is recorded.

Salt spray corrosion testing was carried out as described in ASTM B117 for up to 1000 hours. After intervals of 250 hours, the test panels were removed from the salt spray cabinet, rinsed, dried and the corrosion assessed in accordance wit ECCA T 8 (1985) test method section 5.5.2. When corrosion creep from the scribed mark reached 4 mm, the test was suspended and the time in salt spray recorded.

Humidity testing was carried out to BS 3900. Test panels were observed at regular intervals and the test suspended at the first signs of blistering.

The results of all these tests are compiled in Table 2:

TABLE 2

| Paint System | T-bend Testing | Boiling Water | Salt Spray | Humidity |
|---|---|---|---|---|
| 1 | 2T | — | 750 hrs | 2000 hrs |
| 2 | 2T | — | 1000 hrs | " |
| 3 | 0T | — | 750 hrs | " |
| 4 | 0T | — | 500 hrs | " |
| 5 | 0T | NPL | 1000 hrs | " |
| 1 | 2T | — | 250 hrs | blistering |
| 2 | 2T | — | 250 hrs | " |
| 3 | 2T | — | 500 hrs | " |
| 4 | 2T | — | 250 hrs | " |

TABLE 2-continued

| Paint System | T-bend Testing | Boiling Water | Salt Spray | Humidity |
|---|---|---|---|---|
| 5 | 2T | 1 hr | 250 hrs | " |

EXAMPLE 2

A solution according to the present invention was prepared as follows:

| | |
|---|---|
| Chromium trioxide | 25.0 g/l |
| Ammonium bifluoride | 6.6 g/l |
| Ammonia solution ("880") to give desired pH. | |

Differing quantities of ammonia solution were added to give seven solutions of different pH.

| | |
|---|---|
| Solution 1 | pH = 1.8 (no ammonia added) |
| Solution 2 | pH = 2.5 |
| Solution 3 | pH = 3.0 |
| Solution 4 | pH = 3.7 |
| Solution 5 | pH = 4.5 |
| Solution 6 | pH = 6.0 |
| Solution 7 | pH = 7.0 |

Cold rolled steel panels were cleaned as described in Example 1 and treated with each of the seven solutions prepared. After drying, the metal panels were coated with a single coat polyester paint system stoved to give a dry film thickness of 17 um. The paint film was subjected to the cross-hatch and tape pull test as described in BS 3900 to examine the adhesion of the paint film. Excellent adhesion was observed on all panels tested.

EXAMPLE 3

A solution according to the present invention was formulated as follows:

| | |
|---|---|
| Chromium trioxide | 12.7 g/l |
| Nickel acetate | 1.0 g/l |
| Ammonium bifluoride | 5.0 g/l |
| Ammonia solution "880" | to pH 7 |

Hot dipped galvanised panels were prepared as outlined in Example 1 and, after drying, were coated with an epoxy primer and a $PVF_2$ top coat. The painted test panels were subjected to salt spray corrosion testing according to ASTM B117. After 750 hours, corrosion creep of less than 4 mm from the scribed mark was observed.

Similar results were obtained when nickel acetate was replaced by soluble salts of cobalt, magnesium, iron or zinc.

EXAMPLE 4

2.0 g/l of phosphoric acid was added to the composition of Example 3 to give another solution in accordance with the present invention. After the pH adjustment, similar test results were obtained.

Having, thus, described the invention, what is claimed is:

1. An aqueous chemical composition suitable for treating a metallic surface prior to application of an organic siccative coating thereto, without requiring a rinse step between the treatment of the metallic surface and the application of the organic siccative coating, the composition comprising:

(a) from 1.5 to 40 g/l (total) of a first component which comprises a compound of Cr(VI);

(b) from 0.3 to 6.0 g/l (total) of a second component comprising a compound of $F^-$; and (c) water;

wherein the composition has a pH of 3.0 to about 9.0.

2. A composition as claimed in claim 1 wherein the composition has a pH which is from 6.5 to 9.0.

3. A composition as claimed in claim 1, wherein the pH is adjusted using volatile anions or cations which are capable of evaporating substantially without leaving a residue.

4. A composition as claimed in claim 1 wherein from 1.5 to 15 g/l of Cr (VI) and about 3 g/l of $F^-$ are present.

5. A composition as claimed in claim 1 wherein chromium trioxide and ammonium bifluoride are present.

6. A method of coating a metallic surface, comprising the steps of:

pretreating the surface by applying an aqueous chemical composition thereto, the composition having a pH of about 3.0 to about 9.0 and comprising:

(a) from 1.5 to 40 g/l (total) of a first component which comprises a compound of Cr(VI) and, (b) from 0.3 to 6.0 g/l (total) of a second component comprising a compound of $F^-$ and (c) water; and following the pretreatment step, applying an organic siccative coating to the metallic surface;

wherein the method proceeds from the pretreatment step to the coating application step without rinsing the metallic surface.

7. A process as claimed in claim 6 wherein the composition is applied in an amount of from 1 to 10 ml/$m^2$.

8. The composition of claim 1, in which the first component further comprises one or more metallic compounds selected from the group consisting of compounds of Ni, Co, Mg, Fe, and Zn.

9. The composition of claim 1, in which the second component further comprises a compound of $PO_4^{3-}$.

10. An aqueous chemical composition suitable for treating a metallic surface prior to application of an organic siccative coating thereto, without requiring a rinse step between the treatment of the metallic surface and the application of the organic siccative coating, the composition consisting essentially of:

(a) from 1.5 to 40 g/l (total) of a first component which consists essentially of a compound of Cr(VI) and one or more metallic compounds selected from the group consisting of compounds of Ni, Co, Mg, Fe, and Zn;

(b) from 0.3 to 6.0 g/l (total) of a second component consisting essentially of a compound of $F^-$ and a compound of $PO_4^{3-}$; and (c) water;

wherein the composition has a pH of 3.0 to about 9.0.

* * * * *